US008020236B2

(12) United States Patent
Kaleta et al.

(10) Patent No.: US 8,020,236 B2
(45) Date of Patent: Sep. 20, 2011

(54) FLOOR SWEEPER WITH CLOTH CLEANING PAD

(76) Inventors: Bryan Kaleta, Darien, IL (US); Mark Kaleta, Chicago, IL (US)

( * ) Notice: Subject to any disclaimer, the term of this patent is extended or adjusted under 35 U.S.C. 154(b) by 511 days.

(21) Appl. No.: 11/904,236

(22) Filed: Sep. 26, 2007

(65) Prior Publication Data

US 2009/0077761 A1 Mar. 26, 2009

(51) Int. Cl.
*A47L 13/00* (2006.01)
*A47L 11/24* (2006.01)
*A47L 11/32* (2006.01)

(52) U.S. Cl. ..... 15/4; 15/41.1; 15/42; 15/44; 15/45; 15/88.4

(58) Field of Classification Search ..... 15/4, 42, 15/44, 45, 52.1
See application file for complete search history.

(56) References Cited

U.S. PATENT DOCUMENTS 5,933,900 A * 8/1999 Wang ..... 15/50.3
6,842,936 B2 1/2005 Policicchio et al.
7,013,528 B2 * 3/2006 Parker et al. ..... 15/403
7,152,267 B2 12/2006 Kaleta
2003/0204923 A1 * 11/2003 Nakamura ..... 15/4
2004/0045126 A1 * 3/2004 Parker et al. ..... 15/403
2005/0005377 A1 * 1/2005 Kaleta ..... 15/42
2005/0115409 A1 * 6/2005 Conrad ..... 95/271

* cited by examiner

*Primary Examiner* — Monica S Carter
*Assistant Examiner* — Stephanie Newton
(74) *Attorney, Agent, or Firm* — Knechtel, Demeur & Samlan

(57) ABSTRACT

A light weight floor sweeper having a very low profile sweeper head that uses a sweeping brush and cleaning pad to slide across the surface to be cleaned. The floor sweeper head is mounted to an elongated handle by means of a universal pivot or universal joint which allows the floor sweeper head to easily pivot about the handle in any direction to pick up debris under over hanging cabinets or under furniture. A sweeping brush is mounted on the bottom of the sweeper head to provide sweeping action as the floor sweeper is moved in any direction. Furthermore there is a soft cleaning pad releasably mounted adjacent to the brush to entrap dust and particles that the brush does not pick up. The brush is powered by a small electric motor. A removable dust-receiving tray is mounted in the sweeper head to receive debris swept by the brush.

10 Claims, 5 Drawing Sheets

60
61
61
34
61
46
46
38
40

FLOOR SWEEPER WITH CLOTH CLEANING PAD

FIELD OF THE INVENTION

This invention relates to handheld floor sweepers and more particularly to a hand held floor sweeper having a sweeping brush powered by an electric motor and a soft cleaning pad for picking up dirt and dust. The inventive sweeper is particularly well suited for cleaning hard floor surfaces such as wood, ceramic tile and marble.

Handheld sweepers have been used in the past to pick up dust and small items from hard surfaces such as wood or tile floors. One type of handheld floor sweeper that has been used extensively in the past is a manually pushed floor sweeper that is not powered by a motor. The handheld sweeper has brushes mounted on a shaft located in the sweeper head that contact the surface to be cleaned. The brushes rotate as the sweeper is pushed and pulled across the floor surface. As the brushes rotate they sweep the loose material up into a dust canister or similar dust-receiving portion in the sweeper head. A problem with this type of floor sweeper is that it only picks up material in the forward or rearward direction as the user pushes or pulls the sweeper across the floor as the sweeper is designed for movement in just the forward or reward directions. The sweeper head does not rotate about its handle for movement in the left or right directions, nor does it easily change directions for cleaning under low overhanging objects such as under cabinets or furniture.

Another problem not solved by this type of sweeper is that it does not have a cloth portion that removes very small dust particles from the floor. The dust remains either on the floor or suspended in the air to resettle on the floor after the sweeper is moved to another location.

Other sweepers have evolved that have the brushes powered by a motor such as illustrated in Applicant's U.S. Pat. No. 7,152,267 issued on Dec. 26, 2006. This sweeper used several brushes mounted about the sweeper head to sweep the dirt into a dust tray. However, it does not solve the problem of catching and retaining small dust particles on a hard surface that were not swept into the dust tray by the brushes.

The invention disclosed herein is a floor sweeper which is extremely light and has a very low profile sweeper head. However as opposed to sweepers of the prior art, it has a brush mounted at the front underside of the sweeper head and also a dust pad mounted behind the brush. The floor sweeper head is mounted to an elongated handle by means of a universal pivot or universal joint. This allows the floor sweeper head to easily pivot about the handle in any direction for easily picking up loose materials under over hanging cabinets or under furniture. The brushes are rotated by a small electric motor. The motor drives the brushes to direct the dirt into the dust-receiving tray in the sweeper head. The cleaning pad contacts the surface to be cleaned and picks up and entraps small dust particles. The dust pad is removable and can be washed or disposed of and replaced by a clean pad.

OBJECTS OF THE INVENTION

It is an object of the invention to provide a handheld sweeper that has a sweeper brush along at least one edge of the sweeper head and a cleaning pad to pick up dust. It is a related object to provide a handheld sweeper that has a cleaning pad that is easily removable for washing and replacement.

It is another object to provide a handheld sweeper that has the sweeper head with both a brush and cleaning pad, with the sweeper head attached to the handle by a universal pivot connection to allow the sweeper head to be moved in any horizontal direction on the floor.

DETAILED DESCRIPTION OF THE PREFERRED EMBODIMENT

Figure 1:
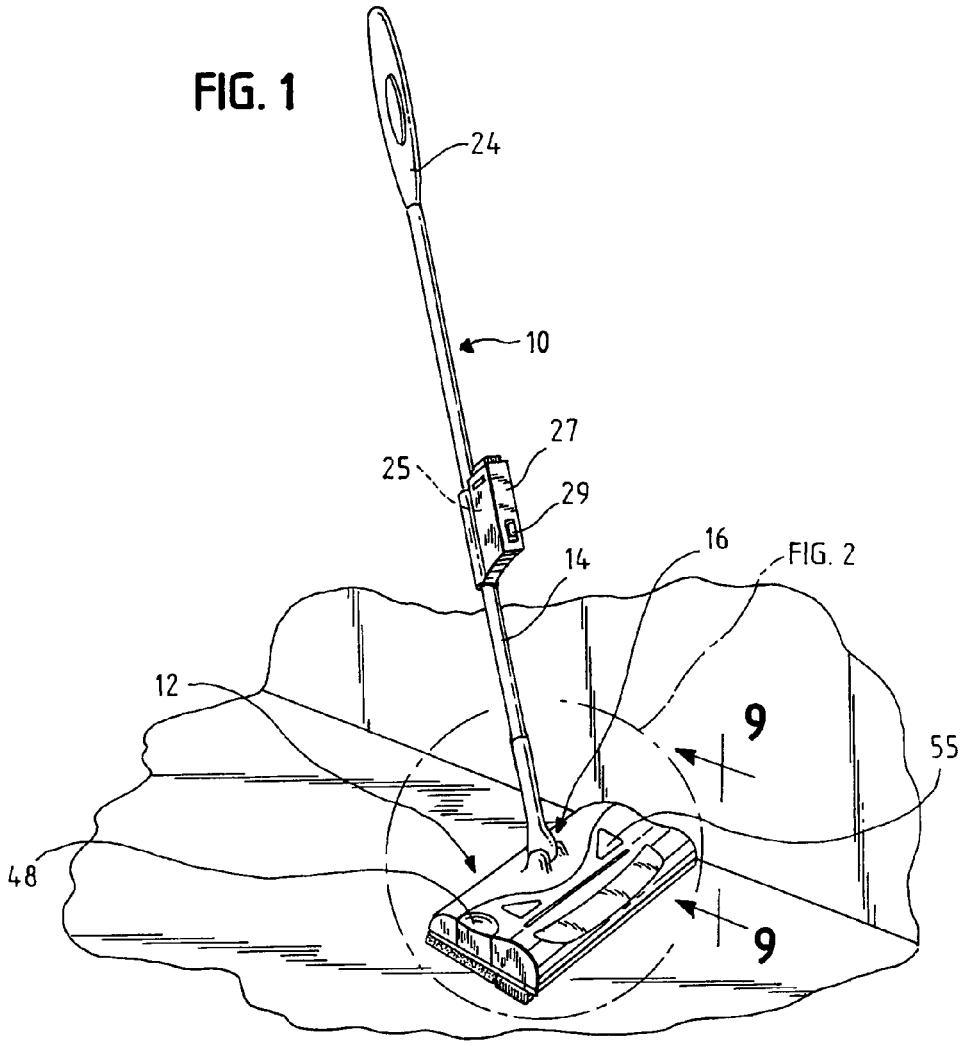
FIG. 1 is a front perspective view of the handheld sweeper with the cloth cleaning pad.
Figure 2:
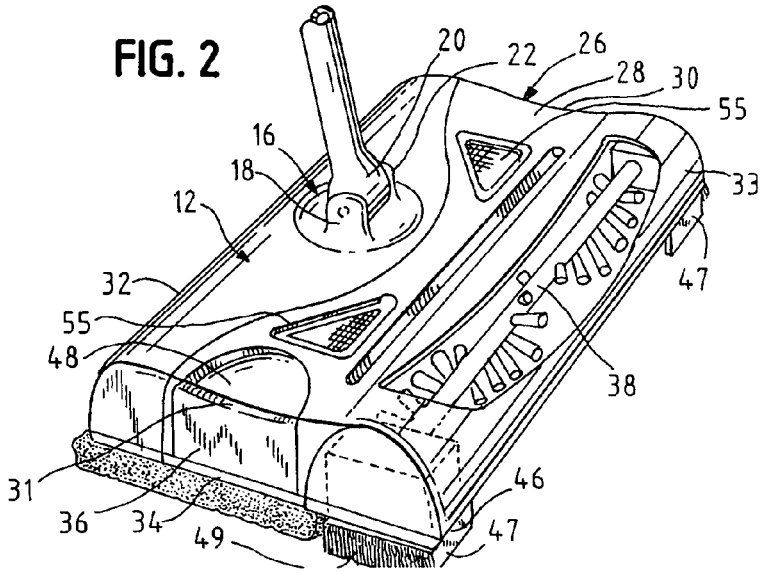
FIG. 2 is an enlarged view of the encircled area of FIG. 1 of the sweeper head with portions removed to show the brushes.

Turning first to FIGS. 1 and 2 a sweeper 10 of the present invention is disclosed. There is a sweeper head 12 connected to an elongated handle 14 by means of a universal pivot 16. The handle 14 is assembled from a series of interlocking pipes or tubes. Spring loaded pins or locks are placed in one end of each of the tubes which interlock with receiving holes in the next adjacent tube. One end of each of tubes has a reduced diameter to be received in the end of the next tube above it so that the receiving tube slides over the reduced diameter end of the inserted tube.

The universal pivot 16 is comprised of a pair of universal pivot supports 18 attached to the head 12. A rotatable ball 20 is mounted on a shaft supported by the universal pivot supports 18. A yoke 22 at the bottom of the handle 14 is rotatably mounted to the ball 20 in a conventional manner to form the universal pivot connection 16. Other types of universal pivot connections can be utilized as will be apparent to those skilled in the art of mechanical pivot connections. It is important that the handle 14 freely rotates about the point of connection between the sweeper head 12 and the handle 14.

At a top end of the handle 14 is a grasping portion 24 which the user holds to push, pull or otherwise move the sweeper 10. A rechargeable battery 25 is mounted in a battery box 27 on the handle 14. The battery 25 provides power to the sweeper head 12 as will be more fully described herein.

FIG. 2 also illustrates the outer design of the sweeper head 12. The sweeper head 12 has a housing 26 comprised of a rectangular top 28, short sides 30 and 31 and long sides 32 and 33. Opposite the top 28 is a bottom 34. Along one of the short sides 31 is a slide out dirt tray 36. The dirt tray 36 extends from the side 31 into the sweeper head 12 to a position adjacent to the opposite side 30. Although the sweeper head 12 is illustrated as rectangular in shape, it can also be formed in other shapes such as circular, triangular or other such shapes.

Figure 3:
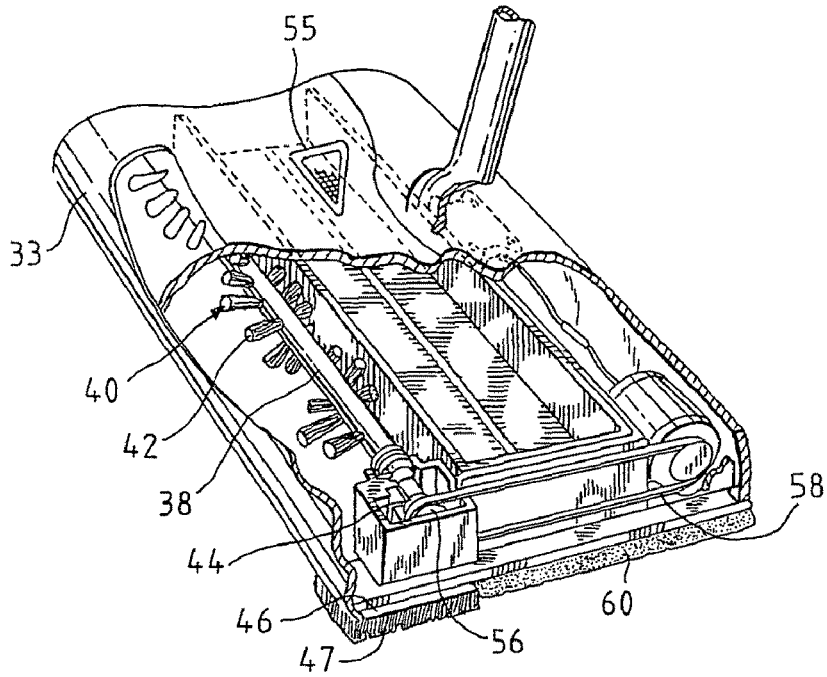
FIG. 3 is a front perspective view of the handheld sweeper head with portions removed to show the electric motor and belt arrangement to drive the brushes.
Figure 4:
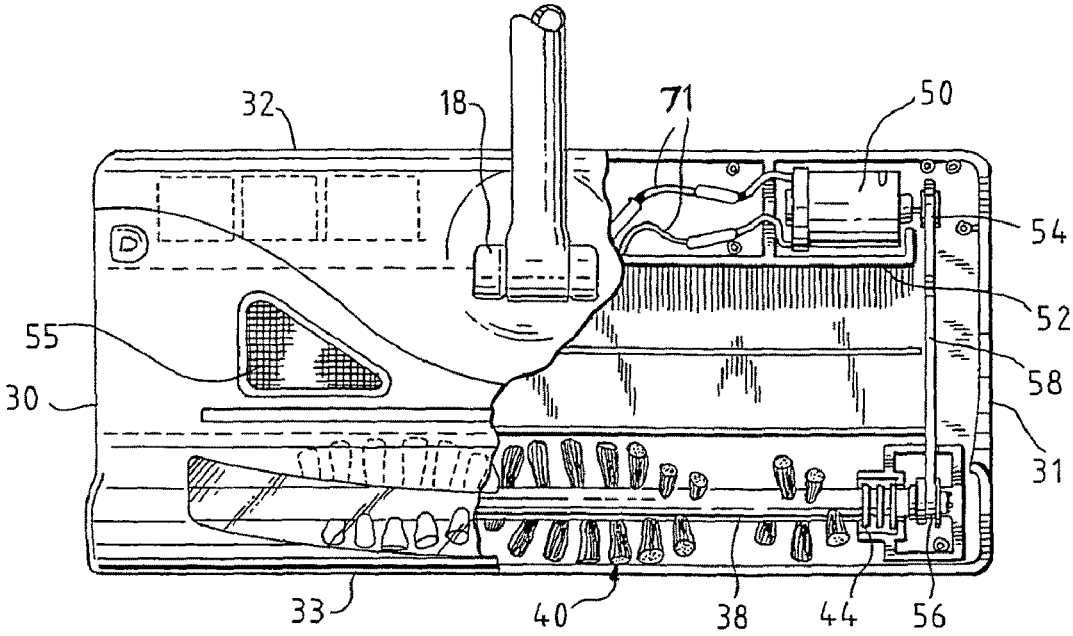
FIG. 4 is a top plan view of the handheld sweeper head with portions removed to show the motor and belt arrangement.

As seen in FIGS. 2-4, along the long side 33 which is at the front of the sweeper head 12 is a shaft 38 with brushes 40 mounted about the shaft. The brushes 40 are formed by radially extending bristles 42 that are designed to contact the floor surface to be cleaned and sweep the debris up from the floor surface. Opposite ends of the shaft 38 are mounted to the sweeper head 12 by means of bearings 44 so that the shaft 38 can freely rotate.

Figure 9:
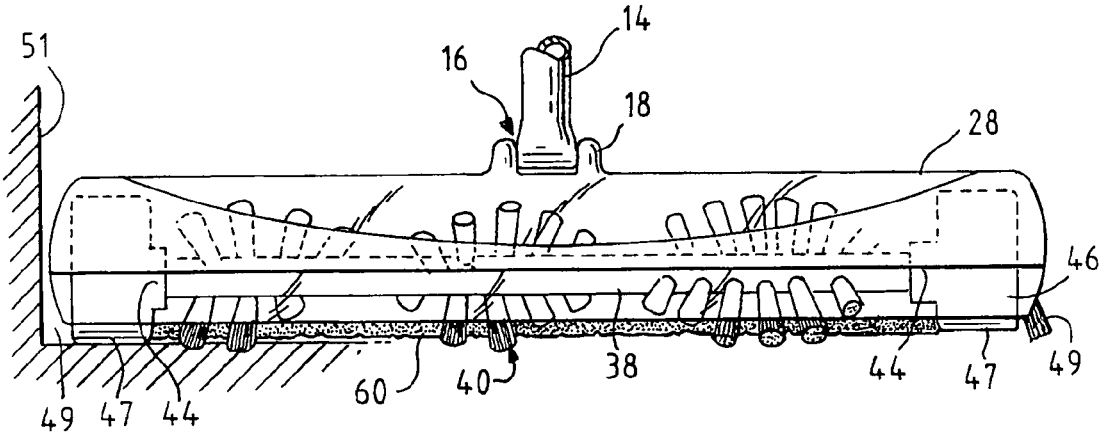
FIG. 9 is a front elevation view of the sweeper head adjacent to a wall.

The sweeper head 12 has front glides 46 that have a soft cloth or soft brush 47 mounted to their undersides that allow the glides to easily slide over the floor without marking or scuffing the floor. These are positioned at the bottom 34 of the sweeper head and in opposite front corners. The front glides 46 may be tapered to direct dirt from the edges toward the brushes 40. The sweeper head can be easily moved in any horizontal direction along the surface to be cleaned, and the arrangement of the brushes along the front does not inhibit movement of the sweeper or lessen the ability of the sweeper head 12 to sweep debris from the surface regardless of the direction of movement of the sweeper head 12. In an alternate arrangement, the glides 46 are polished plastic sliders that allow the glides to easily move over the floor surface without marring or scuffing the floor. The glides may also have brushes or a soft cloth 49 extending out from the sides 30, 31 so that they protect an adjacent wall 51 or furniture from the sweeper head 12 should it contact the wall or furniture. This is more clearly illustrated in FIG. 9.

Figure 5:
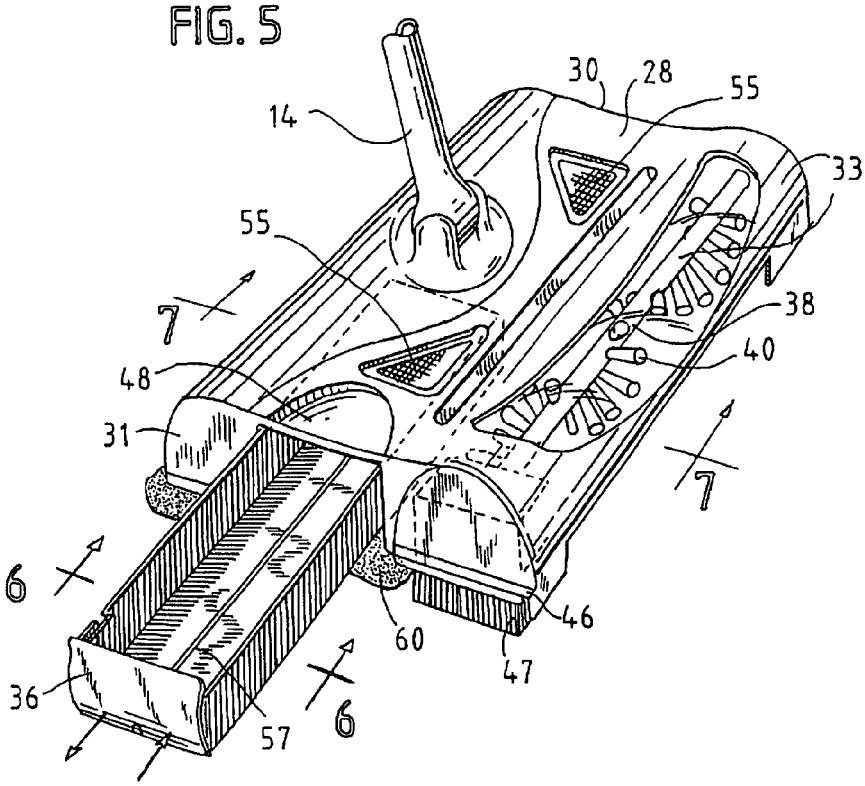
FIG. 5 is a perspective view of the sweeper head with portions removed and the dust tray in a partially removed position.
Figure 6:
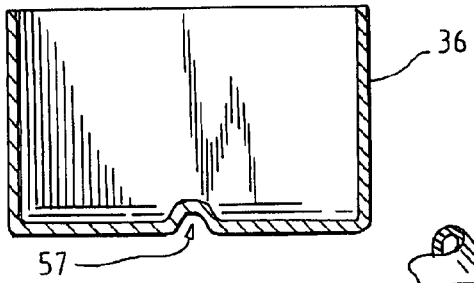
FIG. 6 is a cross section view taken along line 6-6 of FIG. 5 showing the dust tray.
Figure 7:
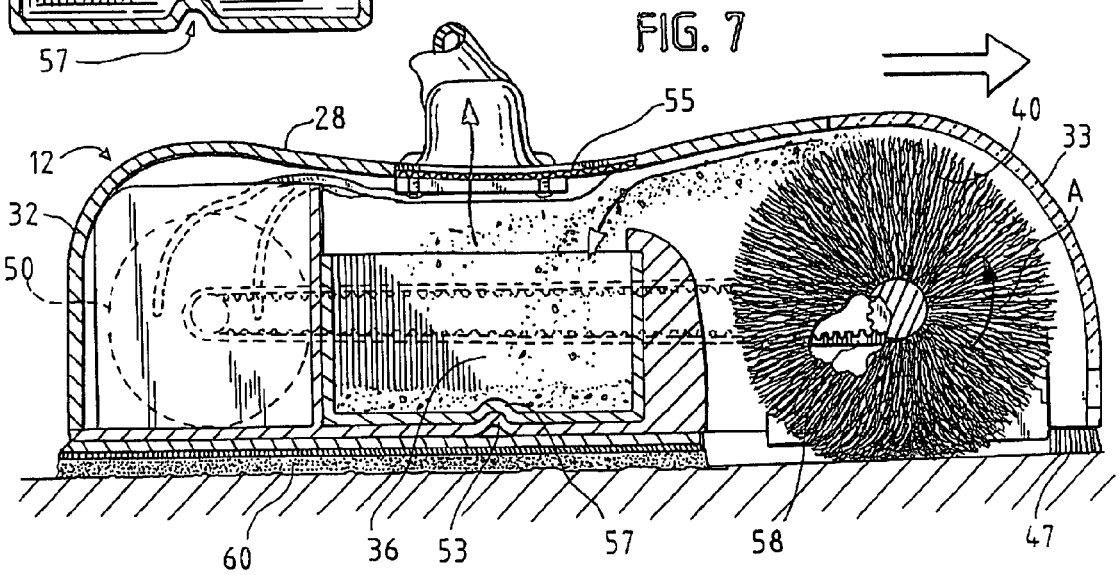
FIG. 7 is a cross section view taken along line 7-7 of FIG. 5 showing the brushes, dust tray and the flow of air from the brushes to the dust tray and out the air vent.
Figure 8:
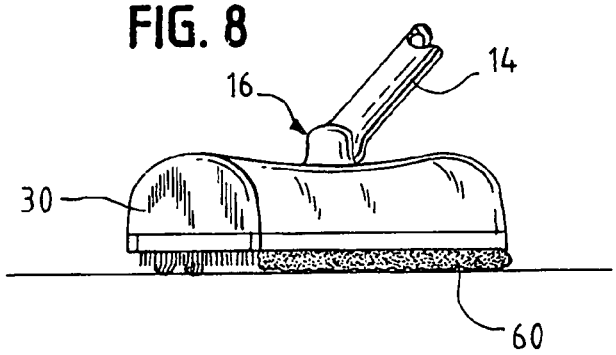
FIG. 8 is a perspective view of the sweeper head with the dust pad contacting the floor.

The slide out dust tray 36 is positioned behind the brushes 40 so that as the shaft 38 rotates it sweeps debris into the tray 36. To remove the tray 36, one needs to only grasp the edge of the tray 36 at a grasping indentation 48 in the top 28 of the sweeper head 12 and slide it out. As seen in FIGS. 5-7, sliding the tray 36 out from the head 12 allows it to be emptied and easily slid back into place for continued use. The tray 36 has a guide 53 in the bottom 34. This is received in a complementary groove 57 in the bottom of the tray 36.

The shaft 38 and brushes 40 are rotationally driven by an electric motor 50 mounted in a motor housing 52. This is clearly illustrated in FIGS. 3 and 4. A pinion 54 is mounted on the output shaft of the motor 50. At the long end 33 or front of the housing 12 is a gear 56 mounted to one end of the shaft 38. A drive belt 58 is wrapped around the pinion 54 and gear 56 so that they are drivingly connected. As the motor drives the drive belt, it simultaneously drives the gear 56 and the shaft 38 with the brushes 40. Regardless of which direction the sweeper head 12 is moved, the motor 50 causes the brushes to rotate in a direction "A" (as seen in FIG. 7) such that the dust or loose material is swept into the sweeper head 12 where it is received in the tray 36.

As seen in FIG. 1, the battery box 27 has a switch 29. The switch 29 turns the motor 50 on and off. Electrical wires 71 pass through the handle 14, through the universal pivot 16, and connect the motor 50 to the battery 25. The battery is removable from the battery box and can be recharged as needed.

Looking at the top of the sweeper head 12, one can see ventilation holes 55 passing through the top 28 which are in fluid communication with the slide out dust tray 36. This gives air which is forced into the dust tray 36 by the rotating brushes 40 an exit passageway. If it were not for the ventilation holes 55 the air which is trapped in the dust tray 36 provides a barrier from dirt and debris being swept into the dust tray 36. This results in the dirt and debris merely being pushed around in front of the brushes 40 instead of being swept into the dust tray 36.

Figure 10:
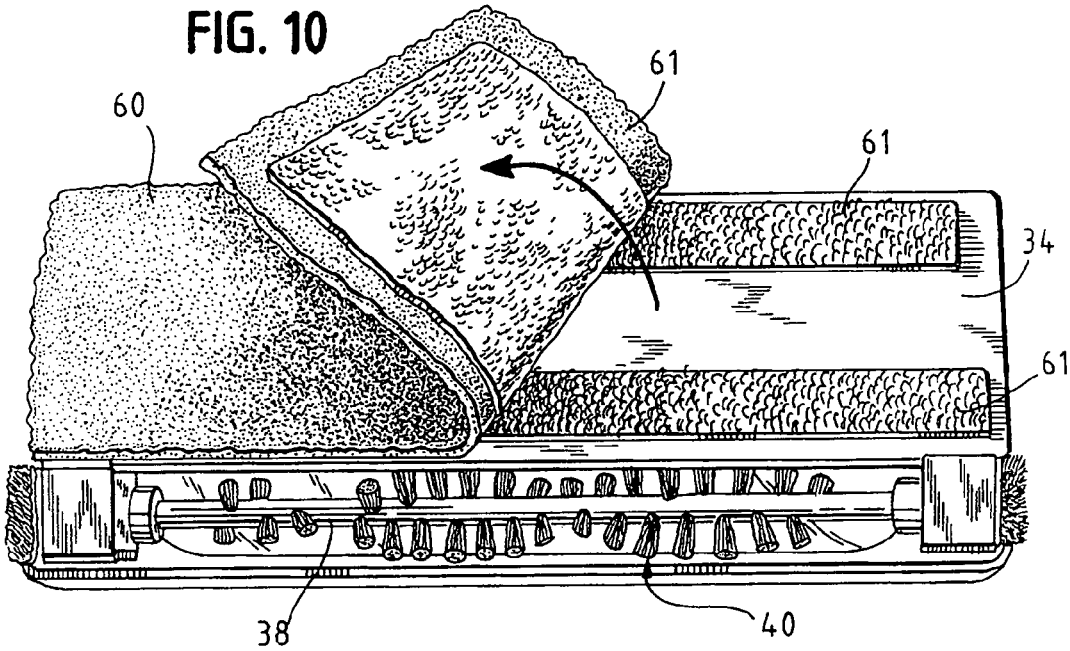
FIG. 10 is a bottom view of the dust pad partially removed from the bottom of the sweeper head.
Figure 11:
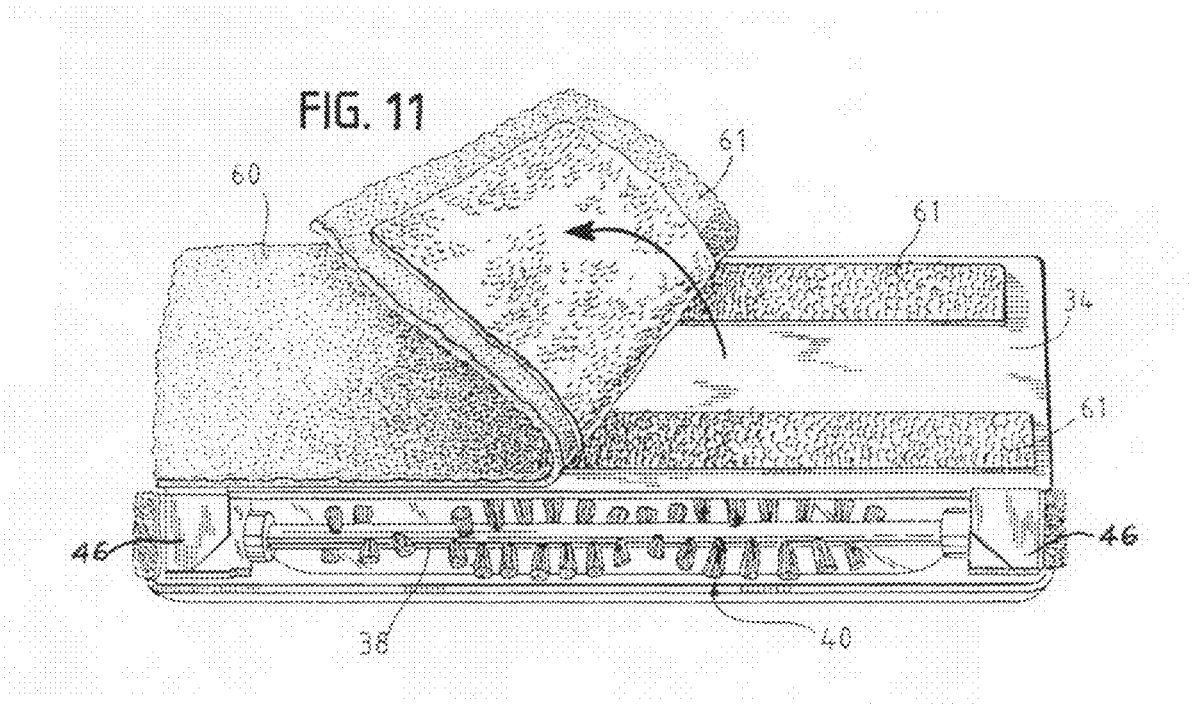
FIG. 11 is an alternative embodiment of the bottom view of the sweeper head showing the tapered front glides with the dust pad partially removed.

Mounted below the sweeper head 12 on the bottom 34 is a soft, dust absorbing, cloth pad 60. The pad 60 can be microfiber or other soft cloth material that retains dust within itself. As used in this application, cloth is defined to include all woven and non woven materials that are used for cleaning purposes and tend to accumulate dust, debris and particles inside or between the material's fibers. The cloth pad 60 is attached to the bottom 34 adjacent to the brushes 40 and extends from the brushes 40 to about ½ inch beyond the rear edge of the long side 32. The cloth pad 60 also preferably extends beyond the short sides 30, 31 on both sides of the head 12 by approximately ½ inch. This allows the pad 60 to form a cushion between the sweeper head 12 and the walls. The pad 60 can be fastened to the bottom 34 by fastening means such as Velcro hook and loop fasteners 61 (as seen in FIG. 10), adhesive, clips, snaps or other commonly known fastening means. It is preferably easily removed so that when it gets dirty it can be removed from the sweeper head 12 and washed. Alternatively it can be removed, discarded, and replaced with a clean pad. The clean or replacement pad 60 is easily attached to the bottom 34 by means of the chosen fastening means. In an alternate embodiment the pad 60 can be mounted on a cushion pad that provides an extra level of cushioning or absorbent material between the pad 60 and the bottom 34.

The overall height of the sweeper head 12 including the brushes and cleaning pad 60 is maintained as a very low profile sweeper to allow the sweeper to get under cabinets, chairs and low overhangs. The universal pivot 16 allows the sweeper head to easily rotate in any direction for ease in reaching tight spots and permits cleaning the entire floor surface. The battery can be a conventional rechargeable battery that is recharged by plugging into a battery charger. The motor and battery are selected to provide adequate power to the brushes for enough time to perform a normal cleaning operation. All of the components can be easily and inexpensively manufactured from plastic or metal. Thus the weight of the sweeper 10 can thus be kept at a minimum for ease of maneuvering.

The combination of the brushes 40 sweeping larger particles into the dirt tray 36 and the pad 60 lifting dust and smaller particles from the floor and retaining them in the pad, provides a new and unique combination cleaning implement. When the pad becomes dirty, it can easily be moved for washing and re-use or replaced if a disposable pad is selected.

Thus there has been provided a floor sweeper that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A floor sweeper comprising:

an elongated handle having opposite top and bottom ends;

a sweeper head with a top, bottom, front, back, and opposite first and second sides, the front, back and opposite sides defining an outer edge of the sweeper head;

a roller having sweeping bristles mounted thereon mounted to the sweeper head for rotation in a first direction;

the front further comprising a front housing enveloping a portion of the roller;

a ventilation opening in the top of the sweeper head in fluid communication with the debris receiving means and the front roller, an air passageway defined between the front roller and front housing, front roller and top, debris receiving means and the ventilation opening in the sweeper head for providing an air flow path from the front roller, through the sweeper head to the debris receiving means and out the top whereby debris in front of the sweeper head is swept into the sweeper head and not pushed away from the sweeper head by air pressure created by the rotating front roller;

mounting means for connecting the sweeper head to the bottom of the elongated handle;

guides mounted to the bottom of the sweeper head adjacent to the front and at each of the opposite first and second sides, the guides having a tapered surface to direct debris from the first and second sides respectively toward the roller;

debris receiving means for receiving the debris swept by the front roller; and a cloth mounted to the bottom of the sweeper head between the roller and the outer edge for picking up and retaining dust particles and debris not swept into the debris receiving means by the roller.

2. The floor sweeper of claim 1 and further comprising a planar mounting surface on the bottom of the sweeper head on which the cloth is mounted.

3. The floor sweeper of claim 1 and further comprising pads mounted to the guides to protect from damage objects struck by the guides.

4. The floor sweeper of claim 1 wherein the mounting means comprises a pivotal mounting means for attaching the bottom end of the elongated handle to the sweeper head.

5. The floor sweeper of claim 4 wherein the pivotal mounting means is a universal joint allowing the elongated handle to pivot 360° about the universal joint.

6. The floor sweeper of claim 1 and further comprising drive means for rotating the first roller in the first direction.

7. The floor sweeper of claim 6 wherein the drive means comprises an electric motor and power source to energize the electric motor, the electric motor connected to the front roller.

8. The floor sweeper of claim 1 and further comprising releasable mounting means for mounting the cloth to the bottom of the sweeper head for removal and replacement of the cloth.

9. The floor sweeper of claim 1 wherein the debris receiving means comprises a removable debris receiving tray.

10. A floor sweeper comprising:

an elongated handle having opposite top and bottom ends;

a sweeper head with a top, bottom, front, back, and opposite first and second sides, the front, back and opposite sides defining an outer edge of the sweeper head;

a roller having sweeping bristles mounted thereon mounted to the sweeper head for rotation in a first direction, the roller having a length extending across a portion of the front of the sweeper head, mounting means for connecting the sweeper head to the bottom of the elongated handle;

guides mounted to the bottom of the sweeper head adjacent to the front and at each of the opposite first and second sides, the guides having a tapered surface to direct debris from the first and second sides respectively toward the center of the length of the roller;

debris receiving means for receiving the debris swept by the front roller; and a cloth mounted to the bottom of the sweeper head between the roller and the outer edge for picking up and retaining dust particles and debris not swept into the debris receiving means by the roller.

* * * * *